United States Patent [19]

Johnson

[11] Patent Number: 4,488,314

[45] Date of Patent: Dec. 18, 1984

[54] PANTLEGGED GARMENT WITH KNEE PROTECTION

[75] Inventor: C. Erteszek Johnson, Los Angeles, Calif.

[73] Assignee: Olga Company, Van Nuys, Calif.

[21] Appl. No.: 466,061

[22] Filed: Feb. 14, 1983

[51] Int. Cl.[3] ..... A41D 13/00

[52] U.S. Cl. ..... 2/23; 2/24

[58] Field of Search ..... 2/23, 24, 78 R, 79, 2/62

[56] References Cited

U.S. PATENT DOCUMENTS

| | | | |
|---|---|---|---|
| 671,059 | 4/1901 | Sanders | 2/23 |
| 727,243 | 5/1903 | White | 2/23 |
| 1,210,342 | 12/1916 | Merritt | 2/79 |
| 1,249,446 | 12/1917 | Mell | 2/78 R |
| 2,355,193 | 8/1944 | Walker | 2/79 |
| 2,568,083 | 9/1951 | Mitchell | 2/62 X |
| 3,496,572 | 2/1970 | Herzig | 2/79 X |

*Primary Examiner*—Louis K. Rimrodt

*Attorney, Agent, or Firm*—William W. Haefliger

[57] ABSTRACT

A lightweight garment protective of the legs and lower torso during exercise, comprises (a) a pant with integral tubular legs, the pant and legs comprising lightweight stretch fabric, and (b) a pad at the knee portion of each leg, there being layers of such fabric at the inner and outer sides of each pad co-operating to retain the pad to the knee portion and sandwiched between the fabric layers, (c) each pad consisting essentially of lightweight batting.

Typically, the fabric of each leg is characterized as elastically stretchable lengthwise of each leg, and in directions about the wearer's leg.

4 Claims, 4 Drawing Figures

PANTLEGGED GARMENT WITH KNEE PROTECTION

BACKGROUND OF THE INVENTION

This invention relates generally to exercise garments, and more particularly to a lightweight garment having elongated tubular legs to fit tightly about the user's legs, there being knee protection on such garment legs.

Aerobic or dancing type exercise has become extremely popular in recent years, and persons engaging in such activity typically wear leotards and tights to free their legs for kicking, leg extension and bending, etc. The exerciser frequently lies down while so moving his or her legs, and damage to the knee can and does occur due to impact or rubbing engagement with the floor surface. Knee protectors can be strapped to the legs; however they are bulky and can loosen and fall off. There is need for means to protect the knees wile exercising, and which allows the legs free movement. Also, there is need for a garment which will warm the legs.

SUMMARY OF THE INVENTION

It is a major object of the invention to provide a garment which will satisfy the above needs. Basically, the lightweight garment protective to the legs (and especially the knees) comprises:

(a) a pant with integral tubular legs, said pant and legs comprising lightweight stretch fabric, and (b) a pad at the knee portion of each leg, there being layers of said fabric at the inner and outer sides of each pad co-operating to retain the pad to said knee portion and sandwiched between said fabric layers, (c) each pad consisting essentially of lightweight batting.

As will appear, the fabric of each leg is typically characterized as stretchable lengthwise, and also in directions about the user's leg, so that it may tightly fit the leg to maintain the pad in position; one of the pad retaining layers is typically formed by the leg fabric itself, the other layer concealed at the innerside of the tubular leg; the two layers are typically stitched together through the pad at lengthwise elongated locations which are spaced apart, the pad at the stitch locations being locally compressed so that it is maintained securely in position and does not bunch or dislocate during fabric stretching in different directions, and so that pad sections thus formed may wrap or fold about the knee as will appear; and loops or stirrups at the bottom of the legs act to prestretch the garment legs to position the pad sections.

These and other objects and advantages of the invention, as well as the details of an illustrative embodiment, will be more fully understood from the following specification and drawings, in which:

DRAWING DESCRIPTION

Figure 3A:
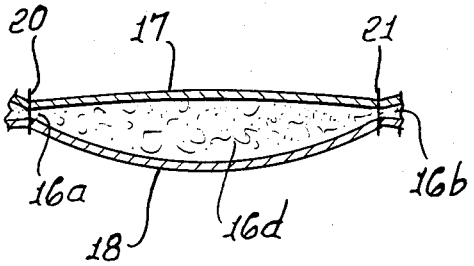
Figure 3B:
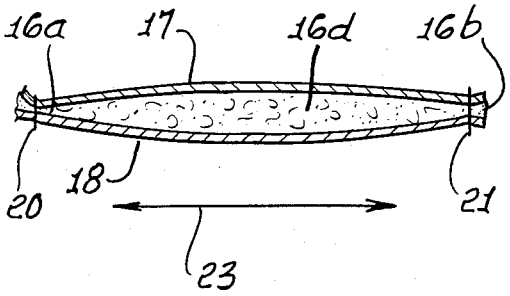

FIG. 3*a* is an enlarged view of a portion of the pad prior to lateral stretching; and FIG. 3*b* is an enlarged view of the FIG. 3 pad portion, after such stretching.

DETAILED DESCRIPTION

Figure 1:
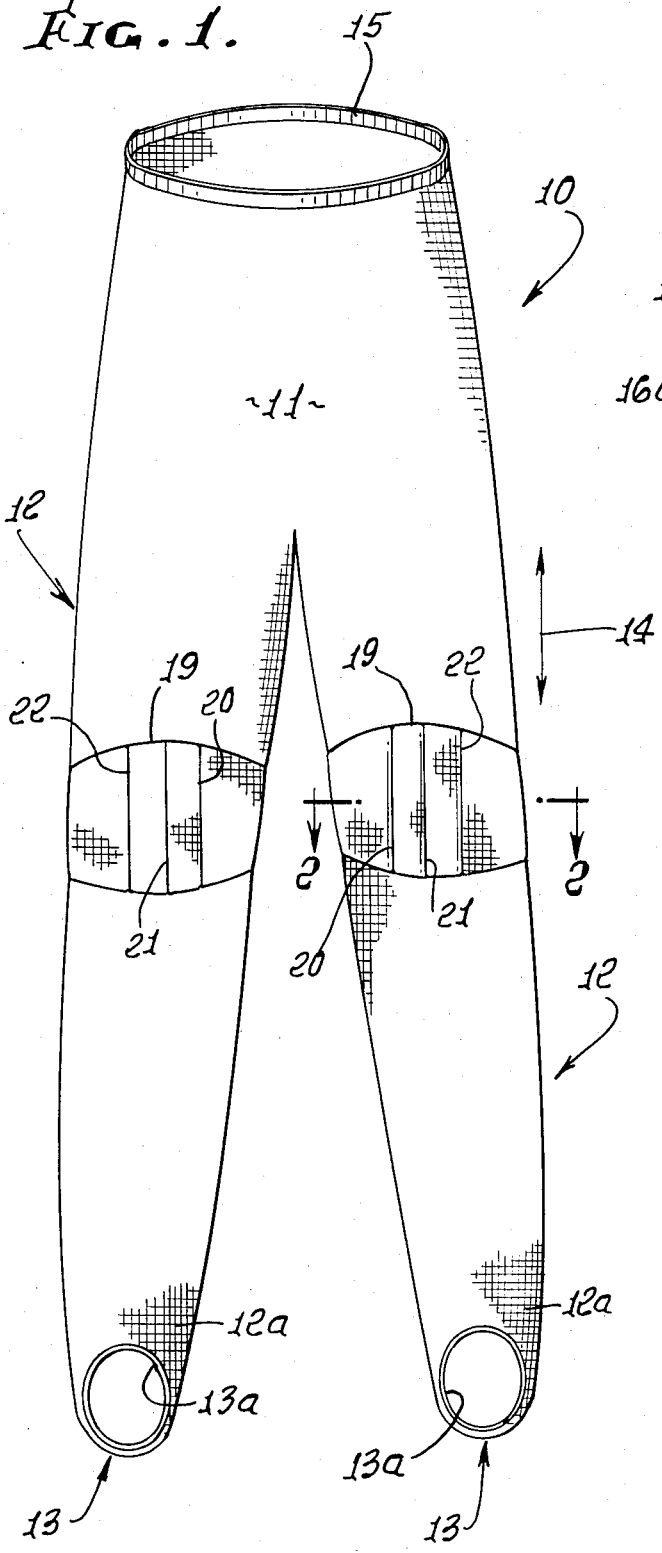
FIG. 1 is a frontal view of the lightweight garment.
Figure 2:
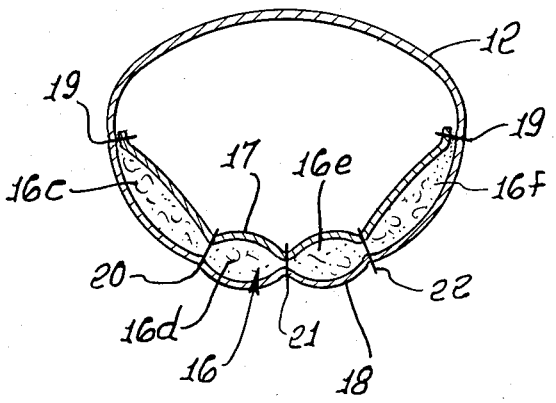
FIG. 2 is an enlarged section taken on lines 2—2 of FIG. 1.

In FIG. 1, the lightweight garment 10 is designed to be protective of the lower torso, legs and knees of a woman, as during active exercise, as for example aerobic exercise. It includes a pant 11 with integral tubular legs 12, typically all in one piece. Retention means may be provided to hold the lowermost extends 12*a* of the legs to the wearer's feet. The retention means is shown to comprise loops or stirrups 13 adapted to extend under the wearer's feet. The pant and legs comprise lightweight elastically stretchable fabric such as interwoven cotton and polyester yarn. It preferably is stretchable in two directions, such as longitudinally lengthwise of the legs (see arrows 14) and also laterally in directions about the wearer's legs and lower torso, so that the garment fits tightly to the body to conform to body active movement. The loops 13 may also consist of the same fabric and be of one piece with the legs and pant.

The loops edges are hemmed at 13*a*, and an elastic waist band is provided in a circumferential loop 15 at the upper edge of the pant.

In accordance with an important aspect of the invention, a pad 16 is provided at the knee portion of each leg, and layers 17 and 18 of the stretch fabric are provided at the inner and outer sides of each pad. Such layers cooperate with one another to retain the pad closely about the knee portion, as by two-way stretching, the pad being sandwiched between such layers. Typically, each pad consists of lightweight batting, of an uncompressed thickness between $\frac{1}{4}$ and $\frac{1}{2}$ inch.

More specifically, one of the layers 17 and 18, and typically the outer layer 18, is formed by the fabric of the leg 12 of the garment to provide a smooth outer appearance; and the other layer 17 is then located at the innerside of the tubular leg (i.e. concealed in that position) and is stitched to the one layer 18. A boundary stitch 19 (between layers 17 and 18) in a loop about the oval pad retains it in position at the garment knee.

The two layers 17 and 18 are also stitched together through the pad at lengthwise elongated locations 20–22 which are lateraly spaced apart at the front of the knee. The pad at such locations is locally tightly compressed between the layers, with a thickness reduced to about 1/16 to $\frac{1}{8}$ inch. See such locations at 16*a* and 16*b* in FIGS. 3*a* and 3*b* associated with stitch locations 20 and 21. The elongated locations 20–22, being laterally spaced apart, create pad folds between pad sections 16*c*–16*f*, such sections being relatively freely hinged or foldable laterally to closely conform to the rounding of the wearer's knee, as also aided by lateral and longitudinal stretching of the fabric near and at the pad.

FIG. 3*b* shows that the pad section 16*d* is laterally stretchable (see arrows 23) with concomitant reduction in pad thickness, between spread apart stitch locations 16*a* and 16*b*. Stretch fabric layers 17 and 18 also appear laterally stretched in FIG. 3*b*. Accordingly, the wearer's knee is given excellent protection by virtue of the close conformance of the elongatable pad sections to the knee shape, and by lateral fold conformance to the rounded knee.

Stirrups 13 may be omitted, if desired, and the leg lower extents may grip the wearer's legs to position the pads.

I claim:

1. A lightweight garment protective of the legs and lower torso during exercise, comprising (a) a pant with integral tubular legs, said pant and legs comprising lightweight stretch fabric, and (b) a pad at the knee portion, of each leg, there being layers of said fabric at the inner and outer sides of each pad co-operating to retain the pad to said knee portion and sandwiched between said fabric layers, (c) each pad consisting essentially of lightweight batting, (d) said fabric of each leg characterized as elastically stretchable lengthwise of each leg, and in direction about the wearer's leg, (e) one of said fabric layers formed by the tubular leg, the other layer located at the innerside of said tubular leg and stitched to said leg, (f) the other layer also being stitched to said one layer through the pad at lengthwise elongated locations which are laterally spaced apart, to define pad folds, (g) the pad at said elongated locations locally tightly compressed between said layers, (h) said pad being generally oval shaped, and said elongated locations extending generally longitudinally lengthwise relative to said leg, said pad folds adapting the pad to conform to the rounding of the wearer's knee, there being at least three of said pad folds, (i) the pad thickness at said elongated locations reduced from between $\frac{1}{4}$ and $\frac{1}{2}$inch to between 1/16 to $\frac{1}{8}$ inch.

2. The garment of claim 1 wherein said fabric consists of (interwoven) cotton and polyester yarn.

3. The garment of claim 1 including retention means on said legs for holding the lowermost extents of the legs to the wearer's feet, and for holding said pads in lengthwise elongated condition.

4. The garment of claim 3 wherein said retention means comprise loops adapted to extend under the wearer's feet, said loops also consisting of said lightweight stretch fabric.

* * * * *